US005138862A

United States Patent [19]

Chasteen et al.

[11] Patent Number: 5,138,862

[45] Date of Patent: Aug. 18, 1992

[54] RAM GUIDANCE SYSTEM

[75] Inventors: Howard C. Chasteen, Westminster; Walter E. Akes, Denver, both of Colo.

[73] Assignee: Ball Corporation, Muncie, Ind.

[21] Appl. No.: 750,208

[22] Filed: Aug. 27, 1991

[51] Int. Cl.[5] ..... B21D 22/00

[52] U.S. Cl. ..... 72/347; 72/349; 72/456; 384/43

[58] Field of Search ..... 72/347, 349, 384, 427, 72/352, 456; 384/43

[56] References Cited

U.S. PATENT DOCUMENTS

| | | | |
|---|---|---|---|
| 1,960,388 | 5/1934 | Martin | 72/349 |
| 1,992,082 | 2/1935 | Martin | 72/349 |
| 3,771,345 | 11/1973 | Paramonoff | 72/349 |
| 3,861,192 | 1/1975 | Suzuki et al. | 72/352 |
| 4,578,981 | 4/1986 | Nishikawa et al. | 72/347 |
| 4,614,104 | 9/1986 | Straw | 72/349 |
| 4,807,459 | 2/1989 | Grims et al. | 72/347 |
| 4,934,167 | 6/1990 | Grims et al. | 72/347 |
| 5,046,862 | 9/1991 | Ng | 384/43 |

FOREIGN PATENT DOCUMENTS

| | | | |
|---|---|---|---|
| 0697552 | 10/1940 | Fed. Rep. of Germany | 72/347 |
| 1931983 | 1/1971 | Fed. Rep. of Germany | 384/43 |
| 2533586 | 2/1977 | Fed. Rep. of Germany | 384/43 |
| 0491878 | 12/1955 | Italy | 384/43 |

*Primary Examiner*—David Jones
*Attorney, Agent, or Firm*—Gilbert E. Alberding

[57] ABSTRACT

An apparatus for forming containers is disclosed having an improved guidance system for guiding a ram along a substantially linear path through a tool pack. The apparatus includes at least one bearing assembly through which the ram reciprocates. Preferably, the ram has a substantially circular cross-section.

4 Claims, 4 Drawing Sheets

RAM GUIDANCE SYSTEM

TECHNICAL FIELD OF THE INVENTION

This invention relates in general to metal container production equipment, and in particular to a method and apparatus for guiding a tool pack ram of a container body-maker along a substantially linear path.

BACKGROUND OF THE INVENTION

To make containers, and in particular metal cans, a tool pack is typically used in conjunction with a ram and a punch in a body-maker to form the container. A cup-shaped can blank is inserted into the tool pack such that the punch engages the blank and then forces the blank through a series of dies to iron the sidewalls of the container. After the sidewalls are ironed and thus formed to their finished thickness, the punch moves the container into a final die for the formation of a domed end. During the formation of the container, it is of great importance to maintain a linear (typically horizontal) pathway for the ram and punch. Any variance from a linear path can result in sidewalls of the container being formed with variations in thickness and unequal strength characteristics leading to possible unexpected failure. Because containers must be formed with the minimum thickness of the sidewalls being sufficient to meet predetermined strength requirements, containers are frequently made with portions of the sidewalls actually being thicker than required in order to ensure that no portion be less than the minimum required thickness. As in many industries, the cost of raw materials is a substantial concern for the manufacturers of containers. Therefore, any extra material that must be used to form the can is an unnecessary expense as well as a waste of the material.

Several devices have been developed to attempt to maintain a linear pathway for the ram and punch. One such device provides a support for a reciprocating ram utilizing a plurality of rollers. Typically, three rollers positioned 120° apart support and guide a ram having ground surfaces to coincide with the rollers. The ram, which originally had a circular cross-section, must be ground to provide flat surfaces thereon to ride on the rollers. The grinding process must be performed with great precision and, consequently, increases the cost of the system. Two of the rollers are fixed in position while a third roller is provided with a spring to allow adjustability and to help keep the ram in contact with the other two rollers. However, due to a less than perfectly linear drive system, some degree of loping (or up and down motion) may be transferred to the ram which may cause the ram to vary slightly from a perfectly linear path. Such non-linear motion causes uneven sidewall thicknesses and tends to wear the ground surfaces on the ram as well as the roller surfaces, reducing the useful life of both. Additionally, the forming and drawing dies may wear unevenly, reducing their lives, and in a worse case, the punch may actually contact one or more of the dies causing damage thereto. Maintenance and repair as a result of such wear or damage can require removal of the entire guidance system for reworking, causing lengthy and expensive downtime. Also as can be appreciated, handling a heavy guidance system can present a safety risk to the personnel involved.

Other devices utilize a liquid bearing assembly for use with either a three shaft arrangement or a single ram arrangement. In either case, the ram is guided by liquid bearings rather than rollers. In theory, such a system provides increased ability to maintain a linear pathway for the ram due to a more uniform pressure on the entire ram circumference. However, in operation, liquid bearings are extremely difficult to maintain and are subject to leakage problems.

Thus, an apparatus is required which enhances the linearity of the pathway of the ram without the inherent difficulties of the prior art.

SUMMARY OF THE INVENTION

The invention disclosed herein comprises a ram guidance system for use in can making tool packs which substantially reduces the problems of previously known guidance systems. The present invention maintains a substantially linear path for the ram yielding a longer life for the components and a reduced likelihood of unevenly distributed container material.

In accordance with one aspect of the present invention, a guidance system is provided for a tool pack of the type having a ram guided punch for forming a container. The guidance system comprises at least one bearing assembly for slidably receiving the ram therethrough. A generally cylindrical mount is provided for securing the linear bearings therein. The cylindrical mount is secured to the tool pack by bulkheads.

The bearing assembly can include any appropriate device which provides a plurality of surfaces for contacting the ram such that contact force between the ram and the surfaces is spread over a greater area. Consequently, the guidance system of the present invention guides the ram in a substantially linear path through the tool pack and reduces the effects of loping. In one embodiment, a pair of spaced apart bearing assemblies is provided within the cylindrical mount, each assembly containing a plurality of linear bearings. The cylindrical mount comprises a central passageway that steps down in diameter from the bearing reception area to the ram passageway area. A ram having a generally circular cross-sectional shape is fitted for the reciprocal linear motion therein. Ball bearings within each linear bearing contact the ram and roll along a linear path when the ram moves. Any wear on the ram due to contact with the ball bearings within the bearing assemblies may be compensated for by simply rotating the ram. Employing linear bearings with a ram having a circular cross-section rather than a ground ram reduces the cost of the present invention and increases the life of the ram and the bearings. Various other arrangements of bearings can also be used.

It is a technical advantage of the present invention that linear bearings are used with a circular cross-sectional ram rather than a ground ram. It is a further technical advantage of the present invention that the loping effects of the ram drive system are reduced, providing a substantially linear pathway for the ram through the tool pack. It is a still further technical advantage of the present invention that containers having a more uniform sidewall thickness are formed with reduced damage to the dies and punch.

BRIEF DESCRIPTION OF THE DRAWINGS

For a more complete understanding of the present invention and for further advantages thereof, reference is now made to the following Detailed Description taken in conjunction with the accompanying Drawings, in which.

DETAILED DESCRIPTION

Figure 1:
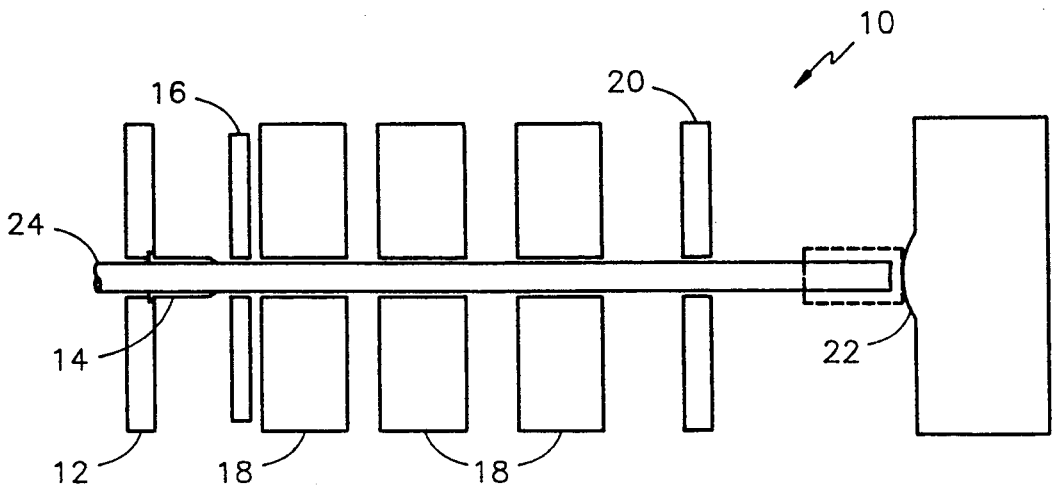
FIG.1 (PRIOR ART)
FIG. 1 is a cross-sectional schematic view of a tool pack used to form a container.

The ram guidance system of the present invention can be used in a conventional container forming apparatus having a tool pack, such as generally indicated by the reference numeral 10 in FIG. 1. The tool pack 10 includes a container body blank positioner 12 and a blank holder 14, a redraw die 16 and one or more wall ironing dies 18. The tool pack 10 also includes a stripper 20 and an end forming die 22. A ram 24 and its included punch (hereinafter, references to "ram 24" will be understood as including the ram/punch combination) is driven to reciprocate linearly through the die pack 10.

In operation, the ram 24 is substantially withdrawn from the tool pack 10 (i.e., its end is positioned to the left of the blank holder 14) and a metal container blank, resembling a shallow cup, is positioned with its open end toward the end of the ram 24. The ram 24 is driven forward (i.e., to the right in FIG. 1) forcing the container blank successively through the redraw die 16 and the series of the ironing dies 18, thereby lengthening and thinning the walls of the container. The ram 24 forces the newly formed container body past the stripper 20 and against the end forming die 22 where the bottom dome of the container is formed. The ram 24 then reverses and begins withdrawing from the tool pack 10; the stripper 20 removes the container body from the end of the ram 24 allowing the completed container body to fall free and be collected for further processing. The ram 24 continues to withdraw until it is in position to receive another container blank.

Figure 3:
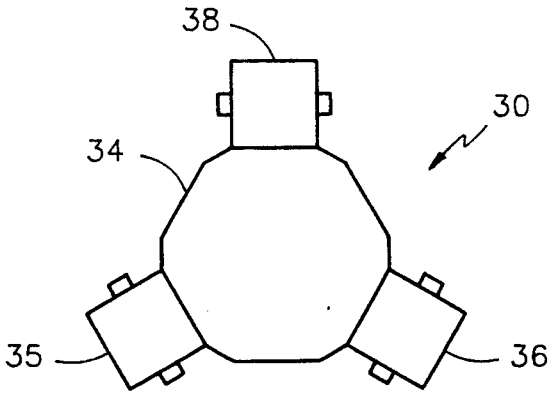
FIG.3 (PRIOR ART)
FIG. 3 is a cross-sectional view of the prior art guidance system taken along line 3—3 in FIG. 2.
Figure 2:
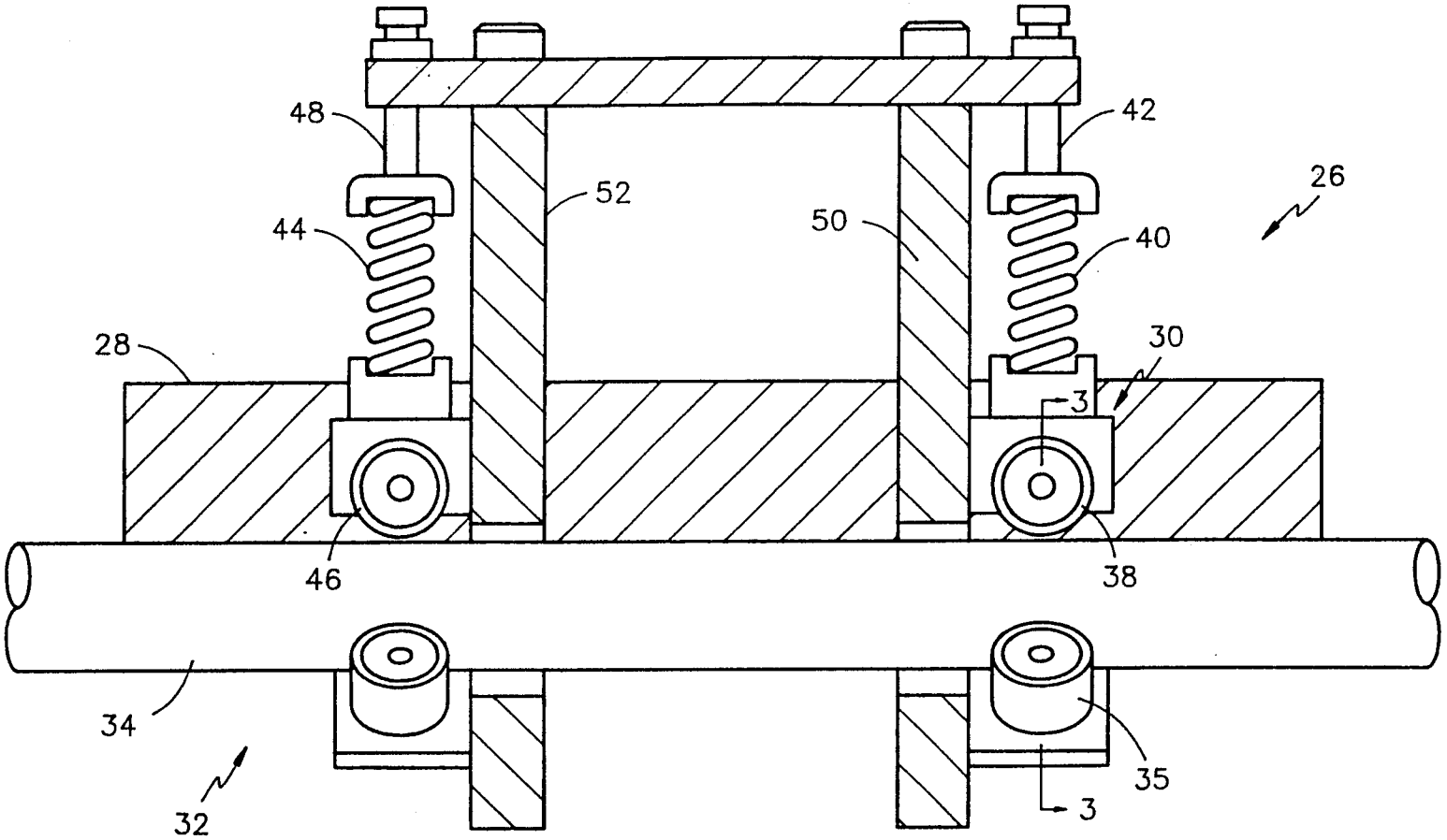
FIG. 2 (PRIOR ART)
FIG. 2 is a cross-sectional view of a guidance system constructed in accordance with the prior art

FIG. 2 is a cross-sectional view of a ram guidance system 26 constructed in accordance with the prior art. It includes a mounting block 28 and first and second sets of rollers 30 and 32 positioned around a ram passage area through which a ram 34 is driven in a reciprocal manner. As detailed in the cross-sectional view of FIG. 3, the first set of rollers 30 (and, similarly, the second set of rollers 32) includes two lower rollers 35 and 36 and an upper roller 38. They are spaced approximately 120° apart around the circumference of the ram 34, the surface of which has been ground with six flat surfaces to permit the surfaces of the rollers 35, 46 and 38 to contact a planar surface of the ram 34 and to provide spare surfaces for wear adjustment. The lower rollers 35 and 36 are fixed in position while the upper roller 38 is urged against the ram 34 by a heavy duty spring 40. The force of the spring 40 against the upper roller 38 can be adjusted with an adjusting bolt 42 in order to compensate for wear on the roller and ram surfaces and to permit calibration following maintenance or repair of the guidance system 26. A similar spring 44 urges upper roller 46 of the second set 32, and is adjustable by an adjusting bolt 48. The first and second sets 30 and 32, along with the springs 40 and 44 and the adjusting bolts 42 and 48, are secured to the mounting block 28 by first and second bulkheads 50 and 52.

In operation, the first and second sets 30 and 32 guide the ram 34 as it reciprocates through the tool pack. As can be appreciated, the springs 40 and 42 must be carefully adjusted with the adjusting bolts 42 and 48 to provide consistent linear motion of the ram 34. However, the surfaces of the rollers and of the ram 34 tend to wear, thus necessitating frequent down time for maintenance. In one adjusting operation, the top rollers 38 and 46 are loosened and the ram 34 is removed and rotated to present new sets of planar surfaces to the rollers. The rollers must be resecured and recalibrated to permit linear motion of the ram 34 through the tool pack.

It may also be necessary for the entire guidance system 26 to be completely removed for the rollers and/or the ram 34 to be either reworked or replaced. Removal and reinstallation can take one hour or more; reworking can take eight to ten hours or more. In a production facility in which each machine produces two hundred or more container bodies per minute, 24 hours per day, such down time is undesirable and represents a significant loss in production ability. It also represents a significant expense in labor. Furthermore, removing and reinstalling a heavy guidance system presents a major safety risk to the maintenance personnel. It can also be appreciated that the ram 34, having flat ground surfaces, is more expensive than it would be if it were left round.

Figure 4:
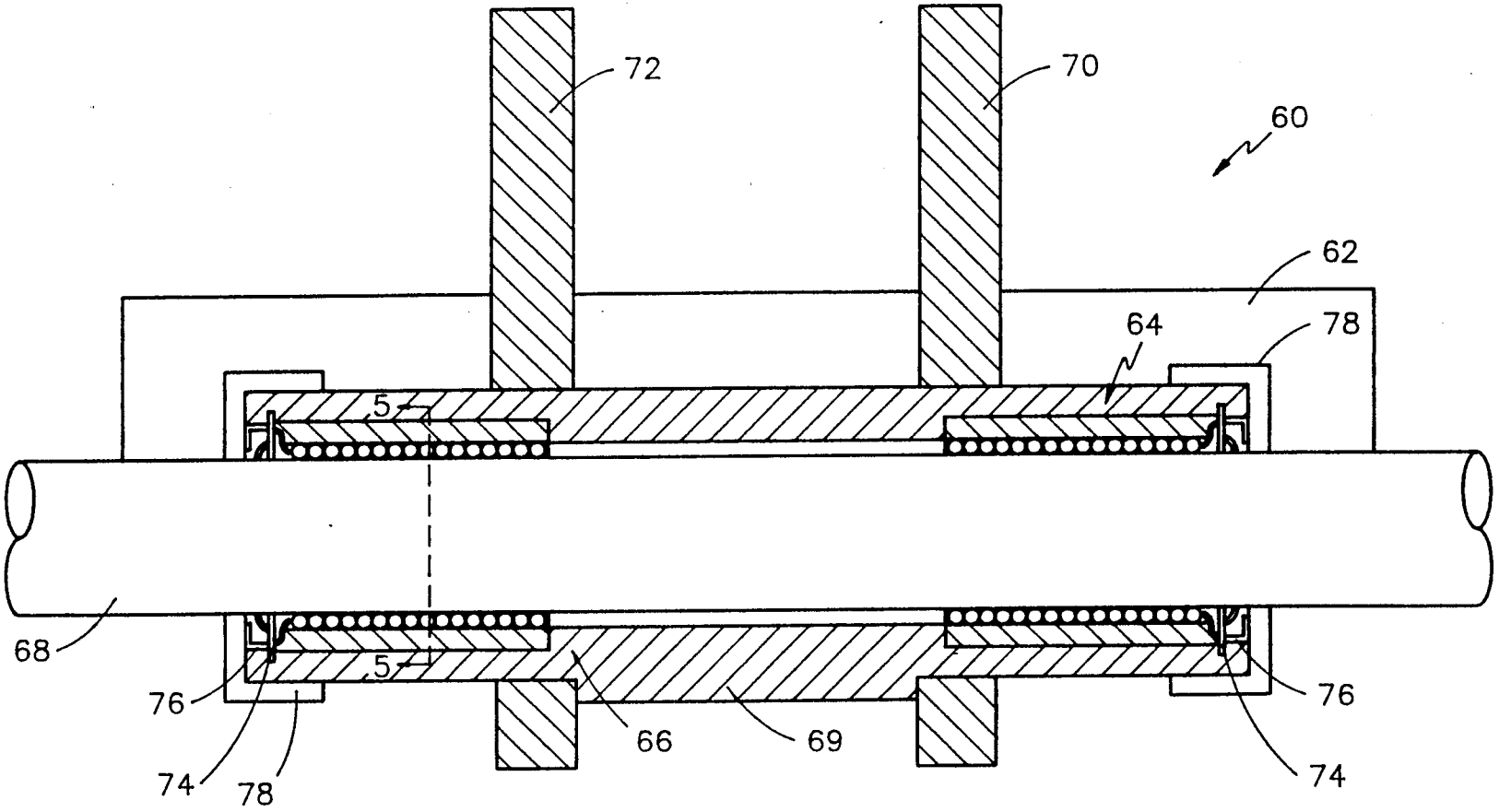
FIG. 4 is a cross-sectional view of a guidance system constructed in accordance with the present invention.

FIG. 4 is a cross-sectional view of a guidance system 60 constructed in accordance with the present invention. The guidance system 60 includes a mounting block 62 and one or more bearing assemblies, such as first and second linear bearing devices 64 and 66, defining a ram passage area through which a ram 68 can reciprocate. The linear bearing devices 64 and 66 are secured to a bearing retainer 69, while first and second bulkheads 70 and 72 secure the bearing retainer 69 to the mounting block 62. A retaining clip 74, a seal 76 and a seal cover 78 hold individual linear bearing sets in place within the first and second linear bearing devices 64 and 66.

Figure 5:
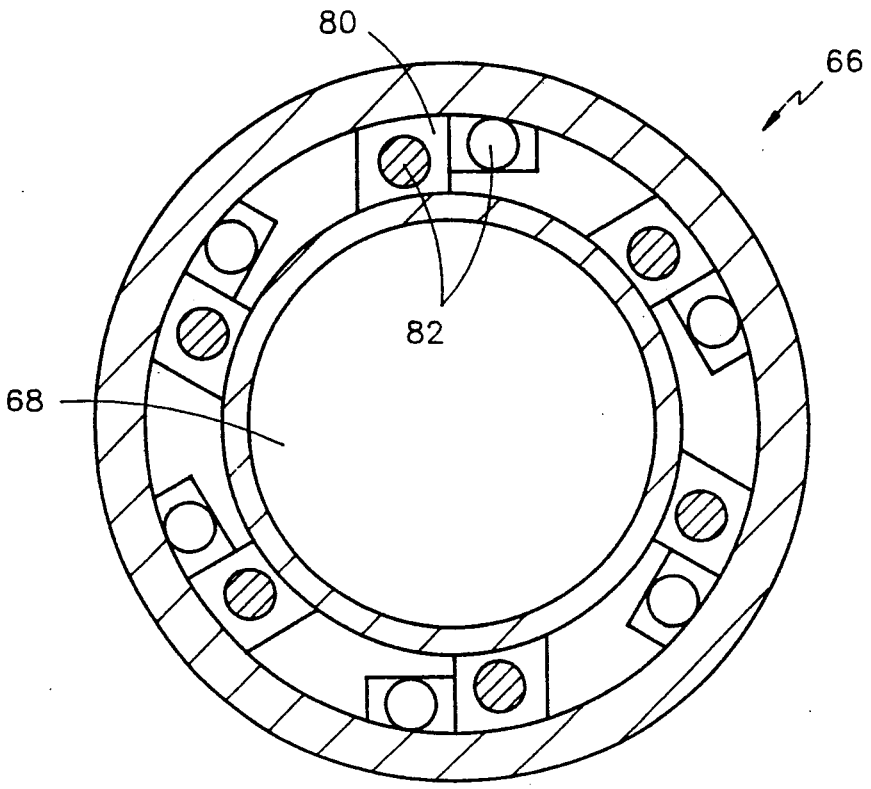
FIG. 5 is a cross-sectional view of the guidance system of the present invention taken along line 5—5 in FIG. 4.
Figure 6:
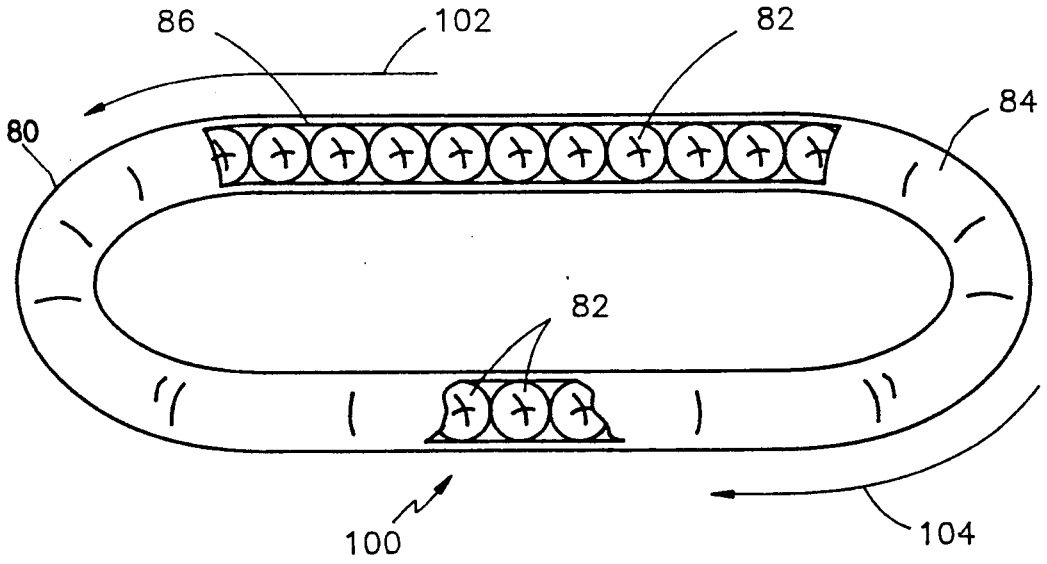
FIG. 6 is a perspective view of a linear bearing set.

FIG. 5 is a cross-sectional view of the second linear bearing device 66 taken along line 5—5 of FIG. 4. Preferably, the second linear bearing device 66 includes six sets of linear bearings spaced substantially uniformly around the ram 68. As illustrated in FIG. 6, a perspective view of one linear bearing set, each linear bearing set, such as linear bearing set 80, includes a plurality of ball bearings 82 in a continuous race 84. The race 84 has an opening 86 formed in a portion thereof to permit several of the bearings 82 to be in contact with the ram 68 at all times. The balance of the race 84 is enclosed and, as shown in FIG. 5, the side of the race 84 opposite the opening 86 is raised slightly to prevent contact with ram 68.

FIG. 6 distinctly illustrates the arrangement of the ball bearings 82 within the race 84. The race 84 is generally oval in shape (although the present invention is not limited to having bearing races of any particular shape) enclosing the ball bearings 82 except at the opening 86. As can be seen at broken portion 100, the bearings 82 completely fill the race 84. Ball bearings 82 which are exposed by the opening 86 contact the ram 68 at a plurality of contact points such that the contact force generated between the ram 68 and the linear bearing set 80 is spread over a greater area. Consequently, the guidance system 60 of the present invention guides the ram 68 smoothly and linearly as it reciprocates through the ram passage area of the tool pack and reduces the effects of loping.

In use, as the ram 68, with a container blank on its end punch, proceeds forward through the series of ironing die 18, the ball bearings 82 in each linear bearing set 80 roll around within the race 84 in one direction, as generally indicated by an arrow 102. When the ram 68 is withdrawn, the ball bearings 82 roll around within the race 84 in an opposite direction, as generally indicated by an arrow 104. As a result, friction, and ensuing wear on contacting surfaces, is substantially reduced. The linear bearing devices 64 and 66 maintain the ram 68 in a substantially linear path, thereby producing a container having walls of more uniform thickness effecting a savings in the amount of materials used. As can be appreciated, the bearing assembly can include any other appropriate device which provides a plurality of surfaces for contacting the ram such that the contact force generated therebetween is distributed over a greater area. Such other devices could include, for example, ball bearings in a circular race disposed around the perimeter of the ram 68 for distributing the contact force and guiding the ram 68 smoothly and linearly through the tool pack. The device could also include sets of linear channels disposed parallel to the ram 68. As the ram 68 reciprocates through the tool pack, ball or roller bearings also reciprocate within the channels.

Additional savings are realized because the ram 68 is not ground with planar surfaces but, rather, retains a substantially circular cross-section. During maintenance and repair, the guidance system 60 can be left in place with just the ram 68, the bearing devices 64 and 66 and the seals 76 being removed and replaced if needed, a procedure which can take less than 30 minutes. And, due to the improved linear alignment of the ram 68 within the tool pack, overall tool life is increased.

Although the present invention has been described in detail, it should be understood that various changes, substitutions and alterations can be made herein without departing from the spirit and scope of the invention as defined by the appended claims. For example, as the ram 68 reciprocates through the tool pack at the rate of 150 to 250 times per minute, heat causes metal parts to expand. A cooling system can be provided to reduce the heat buildup and reduce such expansion. Alternatively, an adjusting mechanism can be provided to automatically compensate for the expansion.

What is claimed is:

1. An apparatus for forming containers from container blanks positioned on a forming axis within the apparatus, each container blank having a longitudinal center axis substantially aligned with the forming axis during container forming operations, the apparatus comprising:

a tool pack comprising:

container forming die means positioned about the forming axis and defining a ram passage area therethrough; and a container forming ram, having a substantially circular cross-section and a longitudinal center axis substantially colinear with the forming axis; and a plurality of guiding means, linearly spaced along said forming axis, for guiding said container forming ram through said ram passage area along a substantially linear path, each of said guiding means comprising:

a plurality of linear bearings each comprising:

a plurality of ball bearings; and a continuous race for retaining said ball bearings having:

a first portion substantially parallel to the forming axis with an elongated opening facing said ram passage area, wherein a plurality of said retained ball bearings protrude through said opening to contact said container forming ram during container forming operations; and a second portion interconnected with said first portion and substantially parallel to said forming axis, said second portion being enclosed for receiving said ball bearings from one end of said first portion and directing said ball bearings to an opposite end of said first portion free from contact with said container forming ram;

wherein each of said guiding means is positioned within a corresponding inner cylindrical portion of a bearing retainer extending substantially parallel to said forming axis, and wherein said plurality of linear bearings of each guiding means are spaced substantially uniformly apart around the forming axis with said first and second portions of adjacent continuous races alternating around said forming axis.

2. An apparatus, as claimed in claim 1, wherein a first guiding means is positioned within a first end of said bearing retainer and a second guiding means is positioned within a second end of said bearing retainer.

3. An apparatus, as claimed in claim 1, wherein each of said guiding means is retained within said corresponding inner cylindrical portion with a retaining means comprising:

a retaining clip;

a seal; and a seal cover.

4. An apparatus, as claimed in claim 1, further comprising mounting means having:

said bearing retainer;

a mounting block secured to said bearing retainer; and a plurality of bulkhead means for supporting said mounting block on the apparatus.

* * * * *